US010336567B2

(12) United States Patent
Rau

(10) Patent No.: US 10,336,567 B2
(45) Date of Patent: Jul. 2, 2019

(54) MANUFACTURING SYSTEM WITH FLAT-BED AND ROTARY DIECUTTERS AND METHOD FOR OPERATING THE MANUFACTURING SYSTEM

(71) Applicant: HEIDELBERGER DRUCKMASCHINEN AG, Heidelberg (DE)

(72) Inventor: Harald Rau, Trabitz (DE)

(73) Assignee: Gallus Stanz- und Druckmaschinen GmbH, Weiden (DE)

( * ) Notice: Subject to any disclaimer, the term of this patent is extended or adjusted under 35 U.S.C. 154(b) by 1471 days.

(21) Appl. No.: 14/138,343

(22) Filed: Dec. 23, 2013

(65) Prior Publication Data

US 2014/0179503 A1 Jun. 26, 2014

(30) Foreign Application Priority Data

Dec. 21, 2012 (DE) ..... 10 2012 025 443

(51) Int. Cl.
*B65H 45/04* (2006.01)
*B26F 1/38* (2006.01)
(Continued)

(52) U.S. Cl.
CPC ..... *B65H 45/04* (2013.01); *B26D 9/00* (2013.01); *B26F 1/384* (2013.01); *B26F 1/40* (2013.01);
(Continued)

(58) Field of Classification Search
CPC . B65H 45/04; B26F 1/384; B26F 1/40; B26F 2001/2218; B31B 1/00;
(Continued)

(56) References Cited

U.S. PATENT DOCUMENTS 3,465,958 A * 9/1969 Gunderson ..... G06K 1/02 234/108
5,129,568 A 7/1992 Fokos et al.
(Continued)

FOREIGN PATENT DOCUMENTS

CN 101564944 A 10/2009
DE 69113613 T2 5/1996
(Continued)

OTHER PUBLICATIONS

German Patent and Trademark Office Search Report, dated Oct. 16, 2013.

*Primary Examiner* — Andrew M Tecco
*Assistant Examiner* — Mary C Hibbert
(74) *Attorney, Agent, or Firm* — Laurence A. Greenberg; Werner H. Stemer; Ralph E. Locher

(57) ABSTRACT

A manufacturing system for manufacturing folding boxes or labels from a web of printing material, includes a web unwinding device, a flat-bed diecutting and/or stamping/embossing unit disposed downstream thereof, and a product delivery disposed downstream thereof. The flat-bed diecutting and/or stamping/embossing unit is deactivatable and at least one rotary processing module for processing the web of printing material, in particular a rotary diecutting module, is provided between the flat-bed diecutting and/or stamping/embossing unit and the product delivery. This construction of the manufacturing system advantageously allows the planar elements to be processed either by the flat-bed diecutting and/or stamping/embossing unit or by a rotary diecutting module. Thus, the manufacturing system may be operated at high productivity. A method for operating the manufacturing system is also provided.

3 Claims, 4 Drawing Sheets

(51) Int. Cl.

| | |
|---|---|
| ***B26D 9/00*** | (2006.01) |
| ***B26F 1/40*** | (2006.01) |
| *B26F 1/44* | (2006.01) |
| *B31B 50/16* | (2017.01) |
| *B31B 50/88* | (2017.01) |
| *B31B 50/14* | (2017.01) |
| *B31B 50/00* | (2017.01) |

(52) U.S. Cl.
CPC ..... *B26F 2001/4418* (2013.01); *B31B 50/005* (2017.08); *B31B 50/006* (2017.08); *B31B 50/142* (2017.08); *B31B 50/146* (2017.08); *B31B 50/16* (2017.08); *B31B 50/88* (2017.08)

(58) Field of Classification Search
CPC ..... B31B 2201/141; B31B 2201/143; B31B 2201/145; B31B 2201/88; B31B 2201/94; B31B 2201/95
USPC ..... 493/357; 156/108
See application file for complete search history.

(56) References Cited

U.S. PATENT DOCUMENTS

| | | | | |
|---|---|---|---|---|
| 5,224,640 | A | 7/1993 | Fokos et al. | |
| 5,361,960 | A | 11/1994 | Fokos et al. | |
| 7,690,099 | B2 | 4/2010 | Bapst et al. | |
| 8,408,110 | B2 | 4/2013 | Krauss et al. | |
| 2005/0206066 | A1 | 9/2005 | Bittner et al. | |
| 2006/0191426 | A1* | 8/2006 | Timmerman | B26D 5/32 101/24 |
| 2006/0281613 | A1* | 12/2006 | Bapst | B26F 1/384 483/28 |
| 2012/0006212 | A1 | 1/2012 | Demand | |

FOREIGN PATENT DOCUMENTS

| | | | |
|---|---|---|---|
| DE | 102010026607 | A1 | 1/2012 |
| EP | 0758580 | A2 | 2/1997 |
| EP | 1577239 | A2 | 9/2005 |
| EP | 1731277 | A1 | 12/2006 |
| EP | 2080600 | A1 | 7/2009 |

* cited by examiner

MANUFACTURING SYSTEM WITH FLAT-BED AND ROTARY DIECUTTERS AND METHOD FOR OPERATING THE MANUFACTURING SYSTEM

CROSS-REFERENCE TO RELATED APPLICATION

This application claims the priority, under 35 U.S.C. § 119, of German Patent Application DE 10 2012 025 443.1, filed Dec. 21, 2012; the prior application is herewith incorporated by reference in its entirety.

BACKGROUND OF THE INVENTION

Field of the Invention

The invention relates to a manufacturing system for manufacturing planar elements, in particular made of paper, board, or composite material, particularly folding boxes or labels, from a web of printing material. The manufacturing system includes a web unwinding device, a flat-bed diecutting and/or stamping/embossing unit disposed downstream thereof, and a product delivery disposed downstream thereof. The invention further relates to a method for operating a manufacturing system.

Diecutting refers to the process of cutting with closed geometric cutting shapes, which may be circular, oval, polygonal, or any desired shape. Processes such as stamping with hollow punches, corner trimming, and index cutting, which are common in the further processing of printed products, may also be counted among the diecutting processes. The cutting process is carried out against a cutting pad or against dies. In some cases, it may be a shearing process. What is cut is mainly sheet-shaped, but also web-shaped packaging substrate made of plastic, foil substrate, paper, board, cardboard, or corrugated board. A diecutting process may additionally create crease lines or blind embossments in the blank. Since the final products are packages that are highly sophisticated in terms of their technical and graphic features (special packages for cosmetics, cigarettes, pharmaceuticals, food, etc.), for optimum results, the substrates themselves must meet special requirements, the diecutting tools must operate within narrow tolerances, and the diecutting machine needs to function with a high degree of accuracy and reliability. Flat-bed diecutters are known for that purpose, for example from European Patent Application EP 2 080 600 A1, corresponding to U.S. Pat. No. 8,408,110, which discloses a diecutter in which the printing substrate is transported and processed between a stationary upper table and a lower table that is vertically movable through a toggle lever or an eccentric gear.

For structural reasons, the diecutting force is unevenly distributed across the area of the platen in all flat-bed diecutting and stamping/embossing machines of the prior art. The diecutting force is introduced through individual force introduction points and is thus not applied to the entire area of the platen. The result is a deformation of the upper and lower table as a function of the stiffness of the platen. That in turn causes an uneven distribution of the diecutting pressure across the area of the platen. An uneven distribution of the diecutting pressure is also caused by differences in the levels of the diecutting or creasing knives and by wear on the knives. The uneven diecutting pressure in turn results in inadequate cuts created by the cutting knives of the diecutting tool.

In the prior art, that problem is solved by individually patching up the diecutting knives. Depending on the deviation from a target diecutting force, strips of paper or plastic of varying thickness are glued behind the diecutting knife. That manual patch-up is a time-consuming process that needs to be carried out while the machine is at a standstill. Depending on the number of diecutting knives and the shape to be cut, the patch-up process may take several hours. Such prolonged set-up times result in a low productivity of the machine.

On the other hand, there are rotary diecutting machines that have at least two rotating tool rollers that are easily exchangeable as described, for example, in German Patent Application DE 10 2010 026 607 A1, corresponding to U.S. Patent Application Publication No. 2012/0006212. Rotary diecutting machines may advantageously be operated at high production speeds.

A disadvantage of rotary diecutting machines is that the costs for purchasing and maintaining the required tools are high. As a consequence, rotary diecutting machines can only be efficiently operated for medium and long-run jobs.

SUMMARY OF THE INVENTION

It is accordingly an object of the invention to provide a manufacturing system with flat-bed and rotary diecutters and a method for operating the manufacturing system, which overcome or reduce the hereinafore-mentioned disadvantages of the heretofore-known systems and methods of this general type and which allow a flexible reaction to changing jobs and operation at high productivity.

With the foregoing and other objects in view there is provided, in accordance with the invention, a manufacturing system for manufacturing planar elements, in particular of paper, board, or composite materials. The planar elements are in particular folding boxes or labels. The planar elements are created from a web of printing material. The manufacturing system comprises at least one unwinding device, which may potentially be part of a web-fed rotary printing press. The system further includes a flat-bed diecutting and/or stamping/embossing unit disposed downstream of the unwinding device, potentially a blanking unit disposed downstream of the flat-bed diecutting and/or stamping/embossing unit, and a product delivery in turn disposed downstream of the blanking unit. In accordance with the invention, the flat-bed diecutting and/or stamping/embossing unit is deactivatable. In accordance with the invention, at least one rotary processing module is further provided between the flat-bed diecutting and/or stamping/embossing unit and the product delivery. If only one rotary processing module is provided, it is a rotary diecutting module. If multiple rotary processing modules are provided, at least one of them is a rotary diecutting module. Due to this construction of the manufacturing system, the planar elements may advantageously either be processed by the flat-bed diecutting and/or stamping/embossing unit or by a rotary diecutting module. The decision on whether the flat-bed diecutting and/or stamping/embossing unit is used or the rotary diecutting module may be made based on the volume of the job to be processed to ensure that the more efficient process is selected; or the rotary diecutting module may be used when the flat-bed diecutting and/or stamping/embossing module is deactivated and is being set-up for a new job. Skilful planning of the succession of various jobs combined with the use of either the flat-bed diecutting and/or stamping/embossing unit or the rotary diecutting module in the manufacturing of the planar elements may increase the productivity of the manufacturing system to a considerable extent.

In accordance with another advantageous feature of the manufacturing system of the invention, a further rotary processing module is constructed as a stripping module. Alternatively or additionally, a further rotary processing module may be embodied as a creasing and embossing module.

In accordance with a further particularly advantageous and thus preferred feature of the manufacturing system of the invention, a feed-in device including a compensator is provided upstream of the flat-bed diecutting and/or stamping/embossing unit. The compensator acts to convert a continuous web movement of the web of printing material into an iterative, intermittent web movement for a step-by-step movement of the web of printing material. In a manufacturing system of this type, the tools of the at least one rotary processing module may have a uniform diameter independently of the job and may in particular include carrier cylinders that are at least partially magnetic to retain the tools by magnetic force. Thus, the costs of purchase for the tools and the costs and effort for storing the tools may be significantly reduced.

In accordance with an added particularly advantageous and thus preferred feature of the manufacturing system of the invention, at least one respective guide roller for diverting the web of printing material around the flat-bed diecutting and/or embossing unit may be provided upstream and downstream of the flat-bed diecutting and/or stamping/embossing unit. In other words, the web of printing material is not passed between the lower and the upper platen of the flat-bed diecutting and/or stamping/embossing unit but directly from the upstream unwinding device, which may be part of a web-fed rotary printing press, to the at least one rotary processing module over the guide rollers.

With the objects of the invention in view, there is also provided a method for operating a manufacturing system as described above, which comprises feeding the web of printing material to the at least one rotary processing module in register by the flat-bed diecutting and/or stamping/embossing unit. The transport and guide devices of the flat-bed diecutting and/or stamping/embossing unit are used in order to ensure in-register feeding.

With the objects of the invention in view, there is concomitantly provided a method, which comprises feeding the web of printing material to the at least one processing module by the feed device of the flat-bed diecutting and/or stamping/embossing unit in accordance with an iterative, intermittent web movement. The tools of the at least one rotary processing module and the web of printing material are synchronized relative to each other for the processing operation.

Other features which are considered as characteristic for the invention are set forth in the appended claims, noting that any combination of the invention described above and of the further developments of the invention described above also represents an advantageous further development of the invention.

Although the invention is illustrated and described herein as embodied in a manufacturing system with flat-bed and rotary diecutters and a method for operating the manufacturing system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
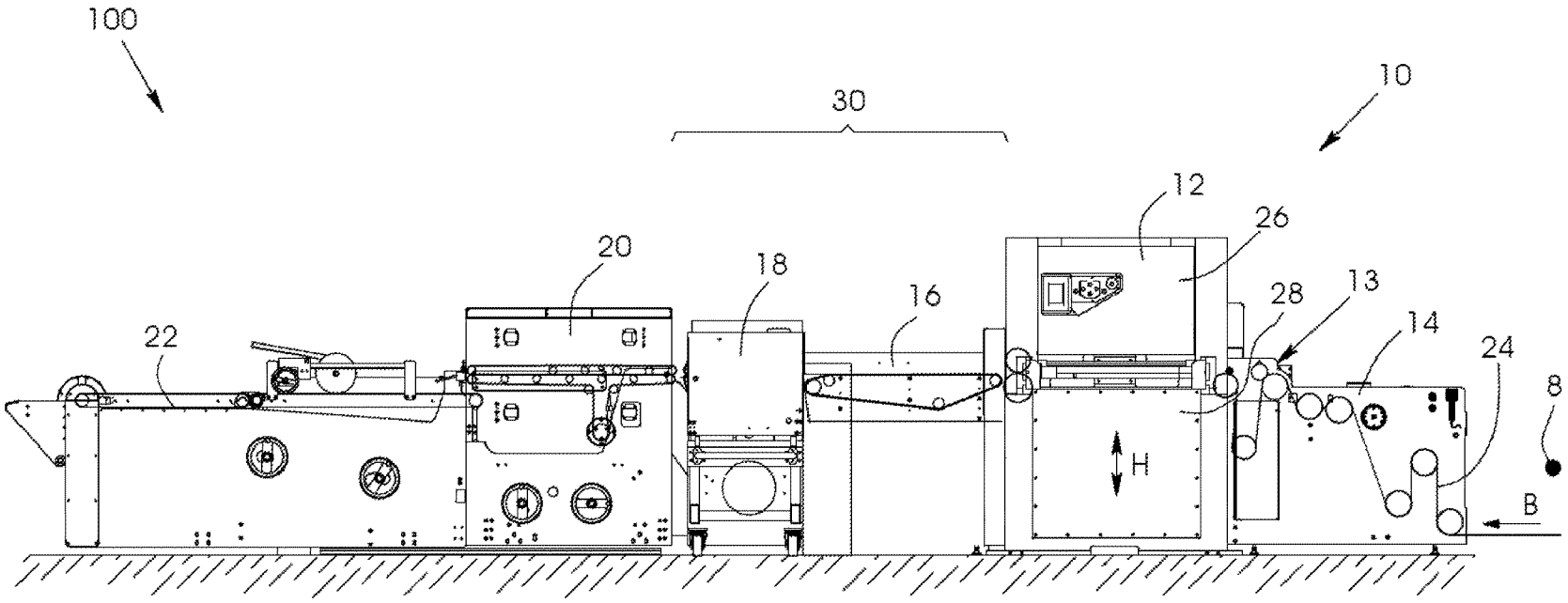
FIG. 1 PRIOR ART
FIG. 1 is a diagrammatic, longitudinal-sectional view of a manufacturing system of the prior art.

Referring now in detail to the figures of the drawings, in which corresponding elements and components are indicated by identical reference symbols and which are not drawn to scale, and first, particularly, to FIG. 1 thereof, there is seen a diagrammatic illustration of a manufacturing system 100 of the prior art including a flat-bed diecutting unit 10. In the illustrated embodiment, the flat-bed diecutting unit 10 includes a flat-bed diecutting module 12 and has a horizontal and modular construction. A web of printing material 24, for example a web of folding boxes printed onto a web of cardboard in an upstream web-fed printing press 8 which may include a web unwinding device, is processed in a processing direction from right to left in this illustration. The web of printing material 24, coming from a web entrance 14, reaches the flat-bed diecutting module 12 in a direction of web travel B through a feed-in device 13. In the flat-bed die-cutting module 12, the web of printing material 24 is cut by a lifting stroke H of a lower platen 28 equipped with diecutting knives and moving against an upper platen 26 in such a way that on one hand, individual sheets are severable from the web of printing material 24 in downstream processing steps and, on the other hand, individual printed products, also referred to as blanks, are stripped from the web of printing material 24 and are separable from each other. The separation into individual sheets is done at the exit of the flat-bed diecutting module 12. The severed sheets travel through a transporting unit 16 disposed downstream of the flat-bed diecutting module 12, enter a stripping unit 18 and enter a blanking unit 20 in which the blanks are separated from the waste and from each other. The blanks are then delivered by a product delivery 22.

Figure 2:
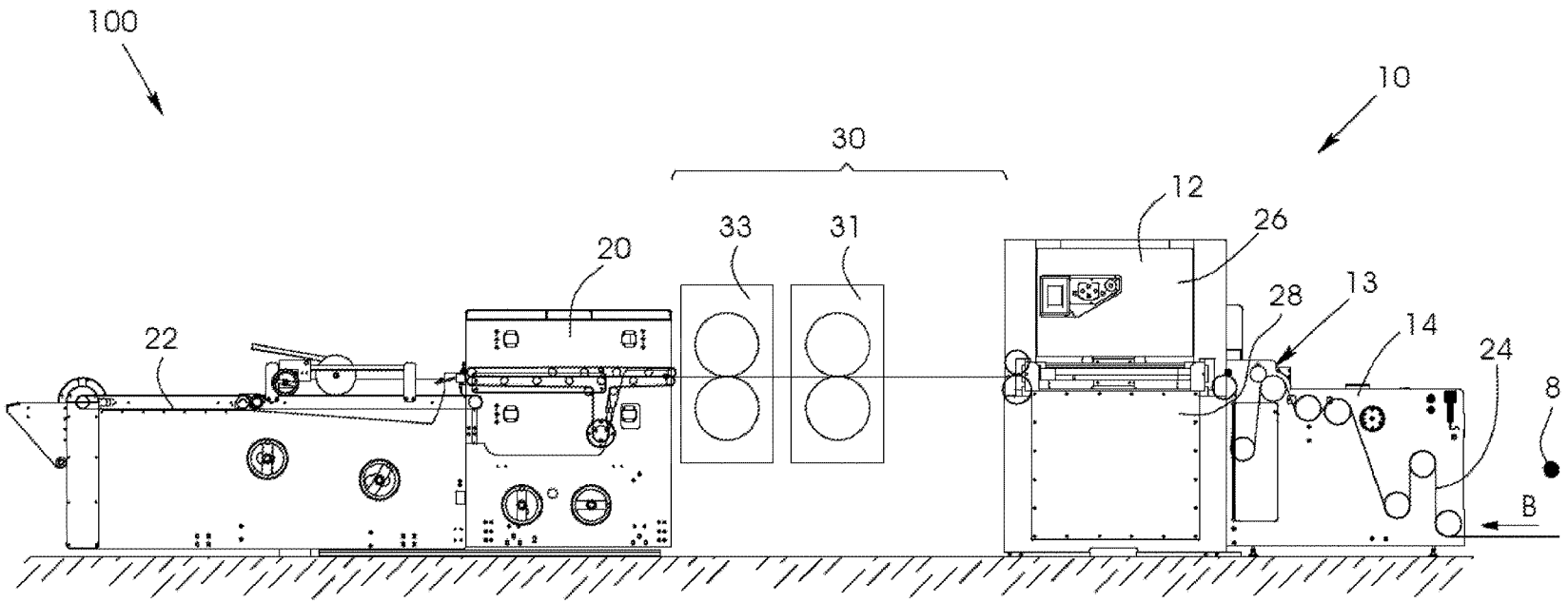
FIG. 2 is a longitudinal-sectional view of a first embodiment of a manufacturing system of the invention including two rotary processing modules.
Figure 3:
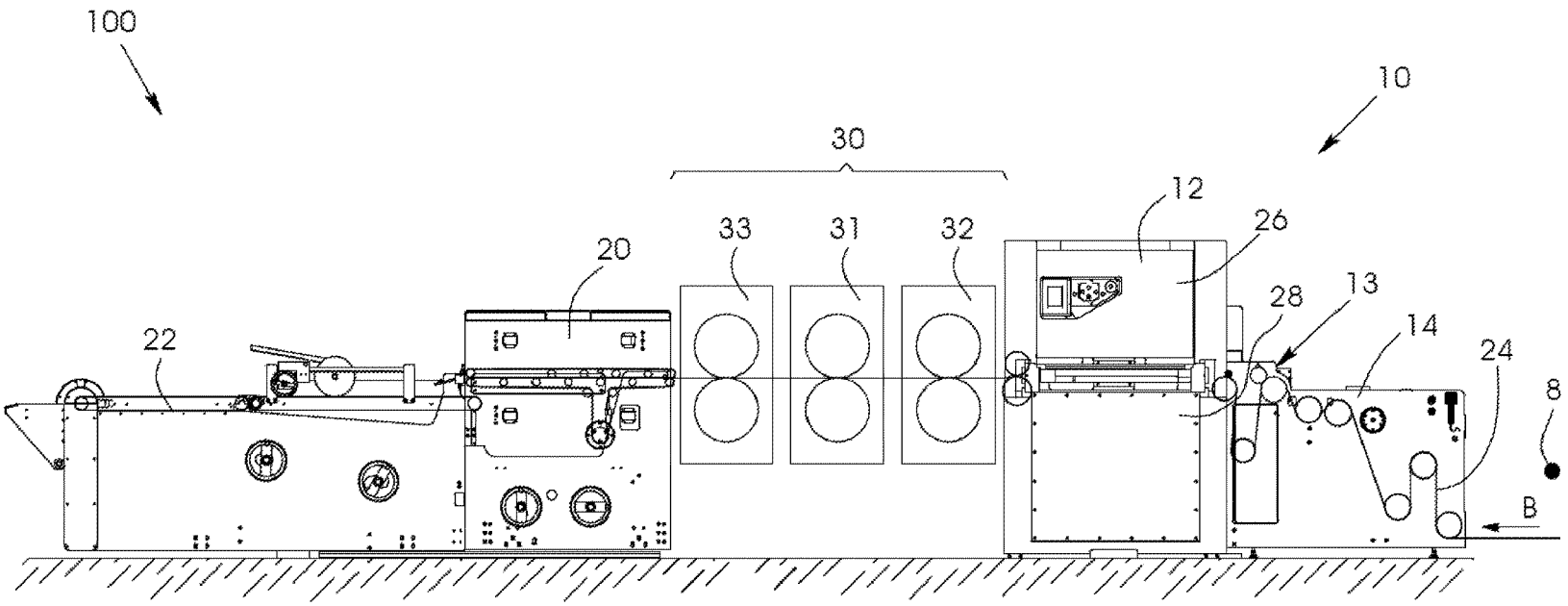
FIG. 3 is a longitudinal-sectional view of a second embodiment of a manufacturing system including three rotary processing modules.
Figure 4:
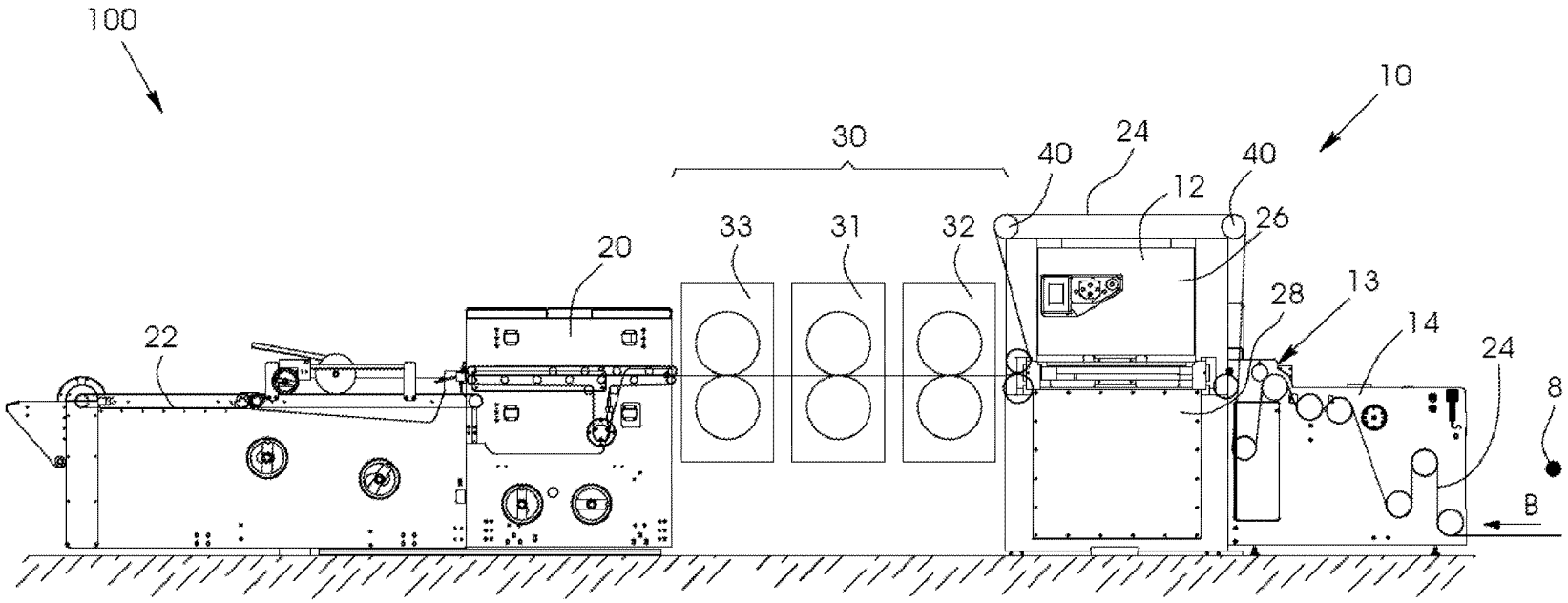
FIG. 4 is a longitudinal-sectional view of a third embodiment of a manufacturing system of the invention including a web deflection device.

FIGS. 2, 3 and 4 illustrate respective manufacturing systems 100 in accordance with the invention. In the embodiment of the manufacturing system 100 of the invention shown in FIG. 2, the flat-bed diecutting unit 10 is deactivated and does not carry out a lifting stroke H. Instead, the web of printing material 24 passes between the upper platen 26 and the lower platen 28 of the flat-bed diecutting module 12 without being processed. A mounting region 30 for rotary tools 31, 32, 33 is located between the flat-bed diecutting unit 10 and the blanking unit 20 with the downstream product delivery 22. In accordance with the illustration of FIG. 2, a rotary diecutting module 31 and a rotary stripping module 33 are provided in this mounting region 30. Thus, the web of printing material 24 is not cut in the flat-bed diecutting module 12 but instead in the rotary diecutting module 31.

In the alternative embodiment of the manufacturing system 100 shown in FIG. 3, three rotary tools have been mounted in the mounting region 30, namely a rotary embossing module 32, a downstream rotary diecutting module 31 and a rotary stripping tool 33.

In contrast to the embodiments of the manufacturing system 100 of the invention described above, in the manufacturing system 100 shown in FIG. 4, the web of printing material 24 does not pass through the flat-bed diecutting module 12. Instead, a respective guide roller 40 is disposed upstream and downstream of the flat-bed diecutting module 12. The web of printing material 24 may be guided around the flat-bed diecutting module 12 by using transport rollers provided in the feed device 13 and at the exit of the flat-bed diecutting unit 10. The deflection causes the web of printing material 24 to be guided from the web entrance 14 into the mounting region 13 for the rotary tools 31, 32, 33 without passing the operating region of the flat-bed diecutting module 12. This allows the flat-bed diecutting module 12 to be set up while the manufacturing system 100 continues to be productive. For example, the machine operator may remove or insert the upper tool and the lower tool of the flat-bed diecutting module and patch up the diecutting knives while the manufacturing system is running.

The invention claimed is:

1. A method for operating a manufacturing system, the method comprising the following steps:

providing a manufacturing system for manufacturing planar elements from a web of printing material, the manufacturing system having:

a web unwinding device configured to unwind the web of printing material, a flat-bed unit configured for at least one of diecutting or stamping/embossing by stroking a platen of the flat-bed unit, the flat-bed unit disposed downstream of the web unwinding device and configured to be deactivated by deactivation of the stroking of the platen, a product delivery disposed downstream of the flat-bed unit, and at least one rotary processing module configured to process the web of printing material, the at least one rotary processing module disposed between the flat-bed unit and the product delivery, and the at least one rotary processing module including a rotary diecutting module; and feeding the web of printing material from the flat-bed unit to the at least one rotary processing module.

2. A method for operating a manufacturing system, the method comprising the following steps:

providing a manufacturing system for manufacturing planar elements from a web of printing material, the manufacturing system having:

a web unwinding device configured to unwind the web of printing material, a flat-bed unit configured for at least one of diecutting or stamping/embossing by stroking a platen of the flat-bed unit, the flat-bed unit disposed downstream of the web unwinding device and configured to be deactivated by deactivation of the stroking of the platen, a product delivery disposed downstream of the flat-bed unit, at least one rotary processing module configured to process the web of printing material, the at least one rotary processing module disposed between the flat-bed unit and the product delivery, and the at least one rotary processing module including a rotary diecutting module and tools having a uniform diameter, and a feed device including a compensator disposed upstream of the flat-bed unit and configured to convert a continuous web movement of the web of printing material into an iterative web movement;

feeding the web of printing material from the feed device to the at least one rotary processing module in an iterative web movement; and synchronizing the tools of the at least one rotary processing module and the web of printing material relative to each other.

3. The method according to claim 2, wherein the tools include at least partially magnetic carrier cylinders for retaining the tools by magnetic force.

* * * * *